US009327390B2

(12) United States Patent
Hsieh

(10) Patent No.: US 9,327,390 B2
(45) Date of Patent: May 3, 2016

(54) ELECTRONIC TORQUE WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 280 days.

(21) Appl. No.: 14/104,470

(22) Filed: Dec. 12, 2013

(65) Prior Publication Data

US 2014/0165797 A1 Jun. 19, 2014

(30) Foreign Application Priority Data

Dec. 13, 2012 (TW) ..... 101147213 A

(51) Int. Cl.
*B25B 23/142* (2006.01)

(52) U.S. Cl.
CPC ..... *B25B 23/1425* (2013.01)

(58) Field of Classification Search
CPC ..... B25B 23/1425; B25B 23/147
USPC ..... 81/479; 73/862.21, 862.23
See application file for complete search history.

(56) References Cited

U.S. PATENT DOCUMENTS 6,928,885 B1 * 8/2005 Shiao ..... B25B 23/1425 73/862.21
7,478,566 B2 * 1/2009 Liao ..... B25B 23/1425 73/862.21
8,091,438 B1 * 1/2012 Huang ..... B25B 23/14 73/862.23
8,201,464 B2 * 6/2012 Anjanappa ..... B25B 23/1425 73/862.21
2006/0225519 A1 10/2006 Nakagawa et al.

FOREIGN PATENT DOCUMENTS

TW I341769 5/2011

* cited by examiner

*Primary Examiner* — Hadi Shakeri
(74) *Attorney, Agent, or Firm* — Guice Patents PLLC

(57) ABSTRACT

An electronic torque wrench includes: a wrench main body including ahead section and a shank body, at least one recess being formed on a wall face of one side of the shank body, a top face of the shank body being inward depressed to form a platform, a rear end of the shank body being inward recessed to form a cavity for placing cells therein, a through hole being formed on the shank body in communication with the platform and the cavity; at least one torque sensor disposed in the recess; and an electronic operation/control device disposed on the platform. The outward protruding volume of the operation/control device is reduced to minify the total volume of the wrench and the platform and the recess enhance the flexion of the shank body.

20 Claims, 5 Drawing Sheets

ELECTRONIC TORQUE WRENCH

BACKGROUND OF THE INVENTION

1. Field of the Invention

The present invention relates generally to an electronic torque tool, and more particularly to an electronic torque wrench.

2. Description of the Related Art

The conventional torque wrenches can be classified into mechanical torque wrenches and electronic torque wrenches. The electronic torque wrench is equipped with electronic components and a liquid crystal screen for showing the torque value and other data.

Taiwan Patent No. 1341769 discloses a conventional electronic torque wrench having a shank body 30 and a housing 20 mounted on the outer circumference of the shank body 30. The electronic components are arranged in a front casing section 21 of the housing 20. One or two sensors 40 are disposed on the circumference of the shank body 30 to detect the flexion of the shank body 30 for a user to know the torque value of the wrench.

In the above electronic torque wrench, the electronic components are arranged in the front casing section 21 so that the front casing section 21 has a very large volume. This leads to limitation of use of the wrench. For example, it is impossible to use the wrench in a narrow space.

In addition, in order to effectively detect the flexion of the shank body 30, two sides of the shank body 30 are respectively formed with two recesses 321 in the positions of the sensors 40. The shank body 30 has a relatively small width in a position where the recesses 321 are formed, whereby the section of the shank body 30 with the smaller width serves as a main flexion position of the shank body 30 for the sensors 40 to detect. However, such design still can hardly provide true flexion of the shank body so that the sensors 40 still cannot precisely detect the torque value.

SUMMARY OF THE INVENTION

It is therefore a primary object of the present invention to provide electronic torque wrench, the total volume of which is minified.

It is a further object of the present invention to provide the above electronic torque wrench, which has higher sensitivity and can provide better flexion detection effect and more precise torque value.

To achieve the above and other objects, the electronic torque wrench of the present invention includes: a wrench main body including a head section and a shank body connected with the head section, the shank body having a front shank section and a handle section positioned behind the front shank section, at least one recess being formed on a wall face of at least one side of the front shank section, a top face of the front shank section being inward depressed to form a platform, the recess being formed in a position within the range of the platform, a rear end of the handle section being inward recessed to form a cavity, a through hole being formed on the shank body in communication with the platform and the cavity; at least one torque sensor disposed in the recess of the shank body for detecting the flexion extent of the wrench main body; an electronic operation/control device disposed on the platform of the shank body; a tail cap detachably mounted at a rear end of the shank body; a first conductive member and a second conductive member, the first conductive member being disposed in an inner end of the cavity, the second conductive member being disposed in the tail cap; and at least one cell placed in the cavity of the shank body in contact with the first and second conductive members, the electronic operation/control device being electrically connected to the cell through the through hole.

According to the above arrangement, the electronic operation/control device is disposed on the recessed platform, whereby the volume of the operation/control device, which outward protrudes from the shank body, is reduced so that the total volume of the wrench is minified. Moreover, the platform and the recess lead miniaturization of the outer diameter of the shank body in different directions, whereby the flexion of the shank body is enhanced. In this case, the torque sensor will become more sensitive to provide better flexion detection effect and more precise torque value.

The present invention can be best understood through the following description and accompanying drawings, wherein:

DETAILED DESCRIPTION OF THE PREFERRED EMBODIMENTS

Figure 1:
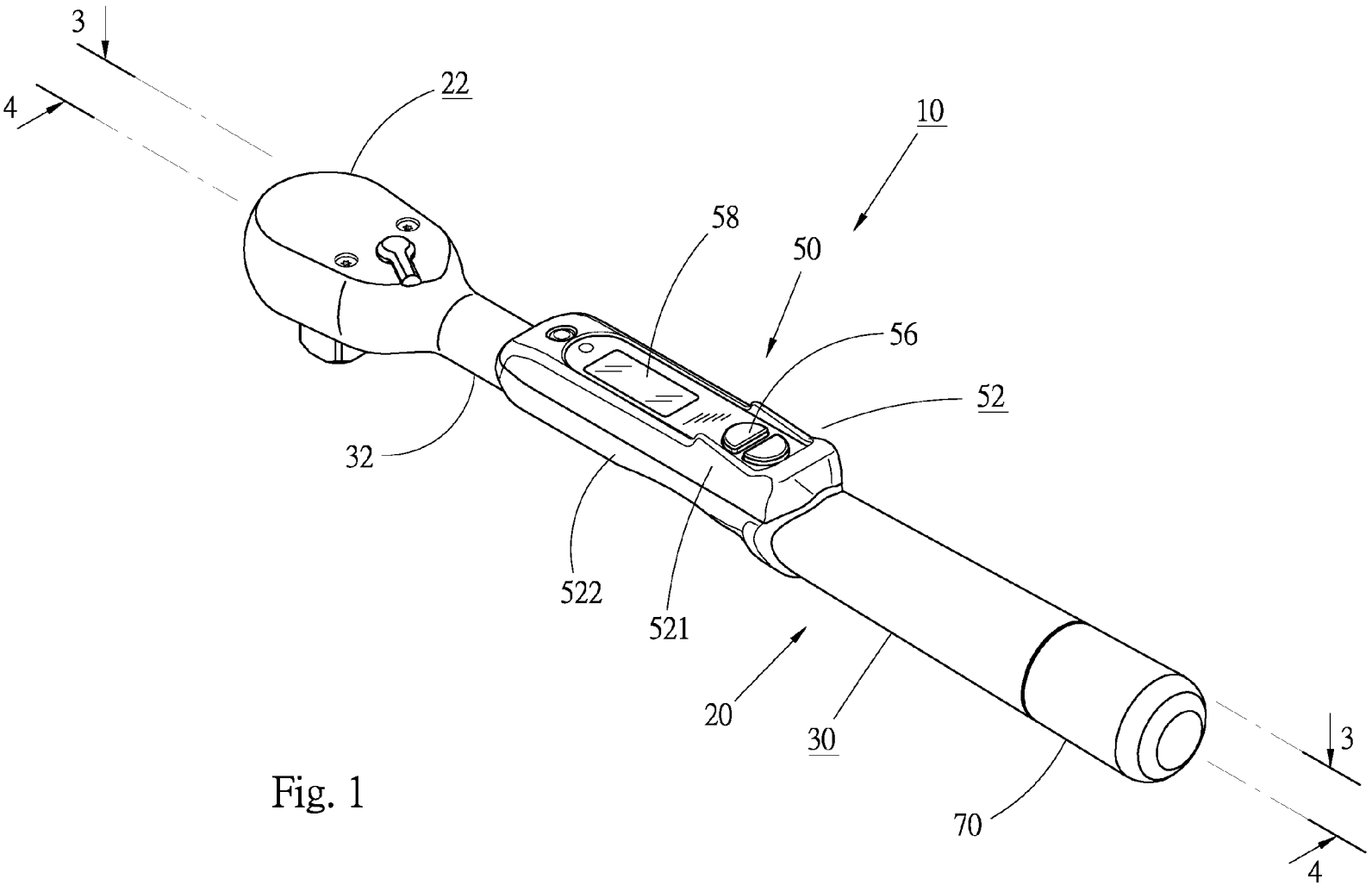
FIG. 1 is a perspective assembled view of a preferred embodiment of the present invention.
Figure 2:
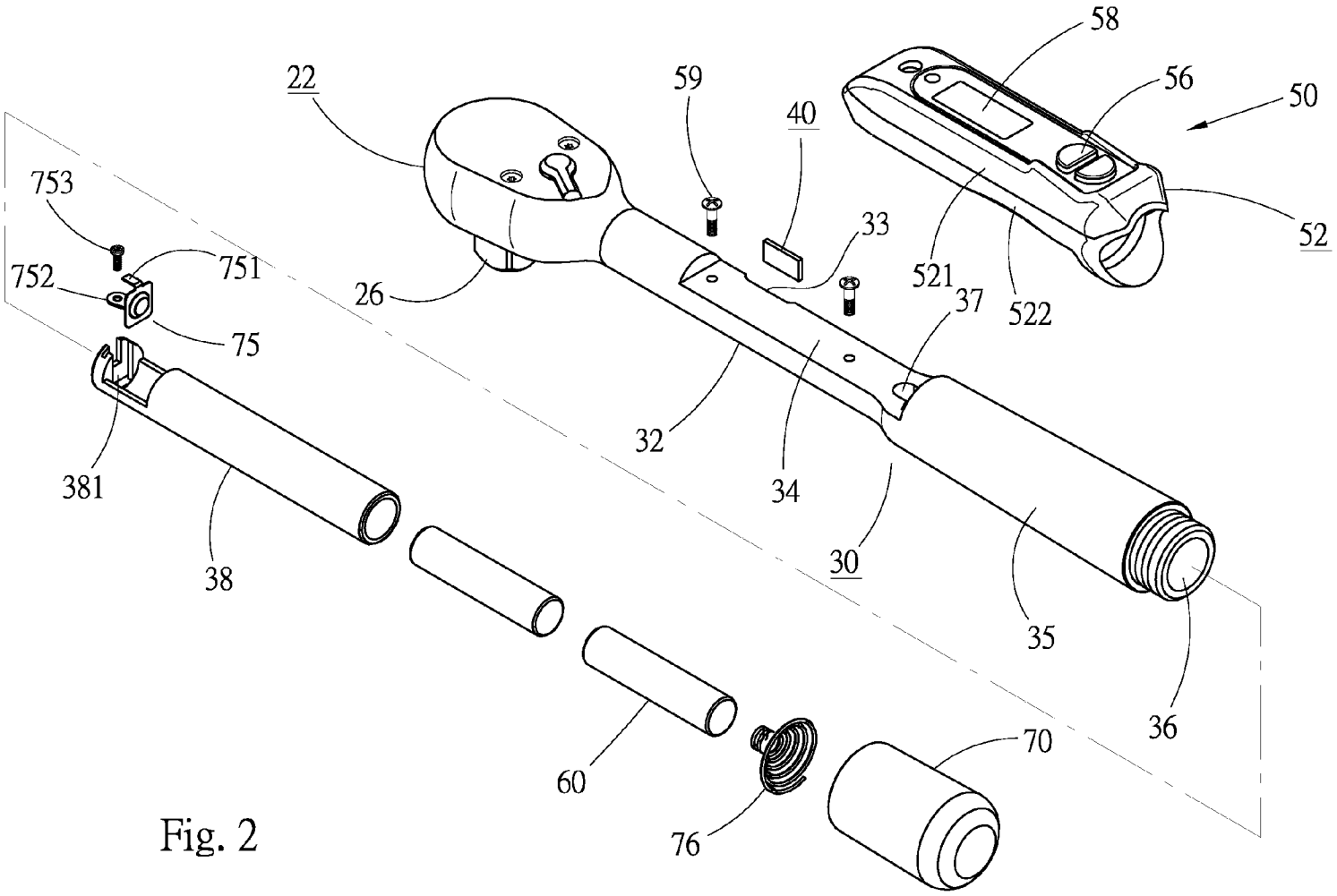
FIG. 2 is a perspective exploded view of the preferred embodiment of the present invention.

Please refer to FIGS. 1 and 2. The electronic torque wrench 10 of the present invention includes a wrench main body 20, a torque sensor 40 mounted on the main body 20, an electronic operation/control device 50 mounted on the main body 20 and one or more cells 60 mounted in the main body 20.

The wrench main body 20 is made of metal material, having a head section 22 and a shank body 30 connected with the head section 22. The head section 22 and the shank body 30 can be integrally formed or pivotally connected with each other. A drive assembly is disposed in the head section 22 for wrenching a threaded member such as a nut or a bolt. Please refer to FIG. 3. The drive assembly generally is, but not limited to, a ratchet assembly having a ratchet 24. The ratchet 24 has a polygonal hole for fitting on a threaded member. Alternatively, the ratchet 24 is provided with an insertion post 26 for connecting with a socket.

Figure 3:
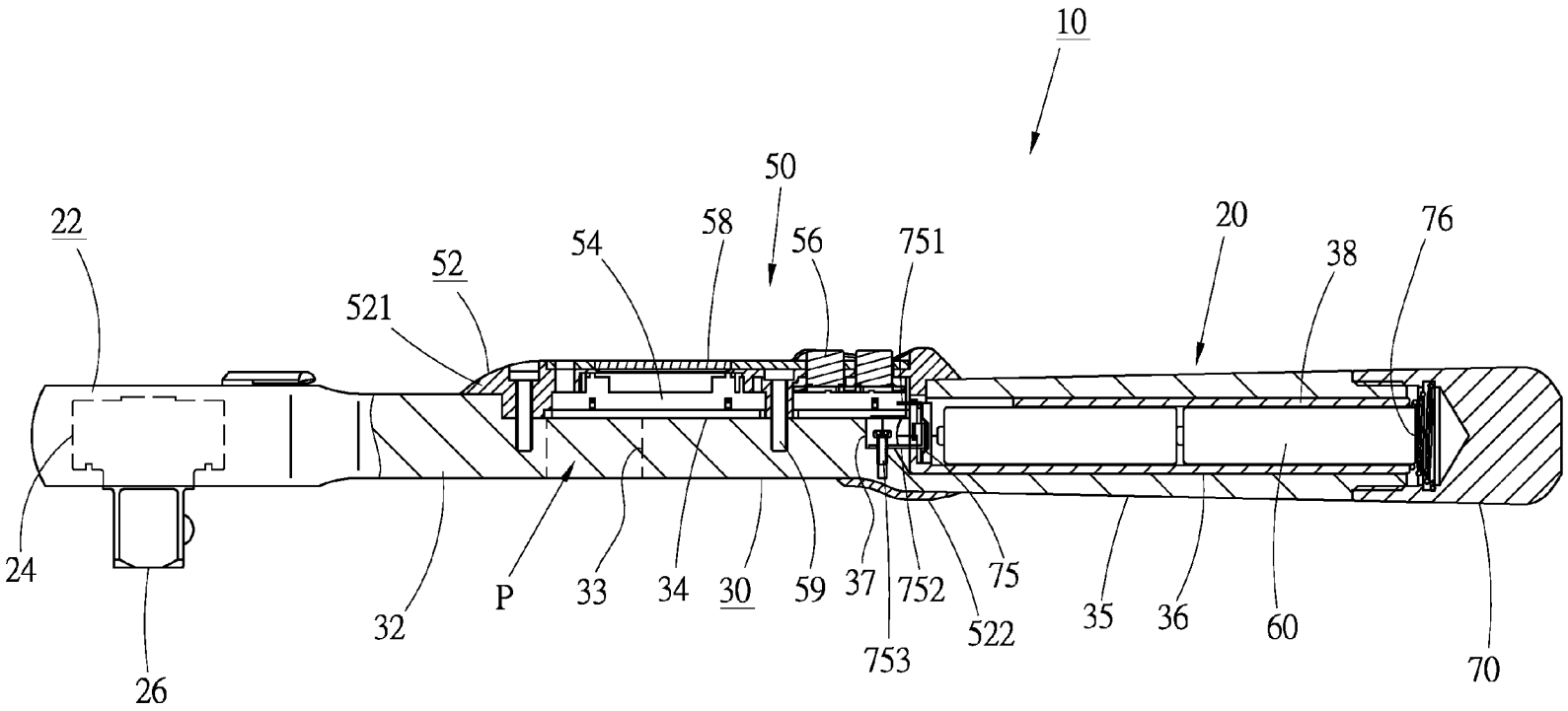
FIG. 3 is a sectional view taken along line 3-3 of FIG. 1.
Figure 4:
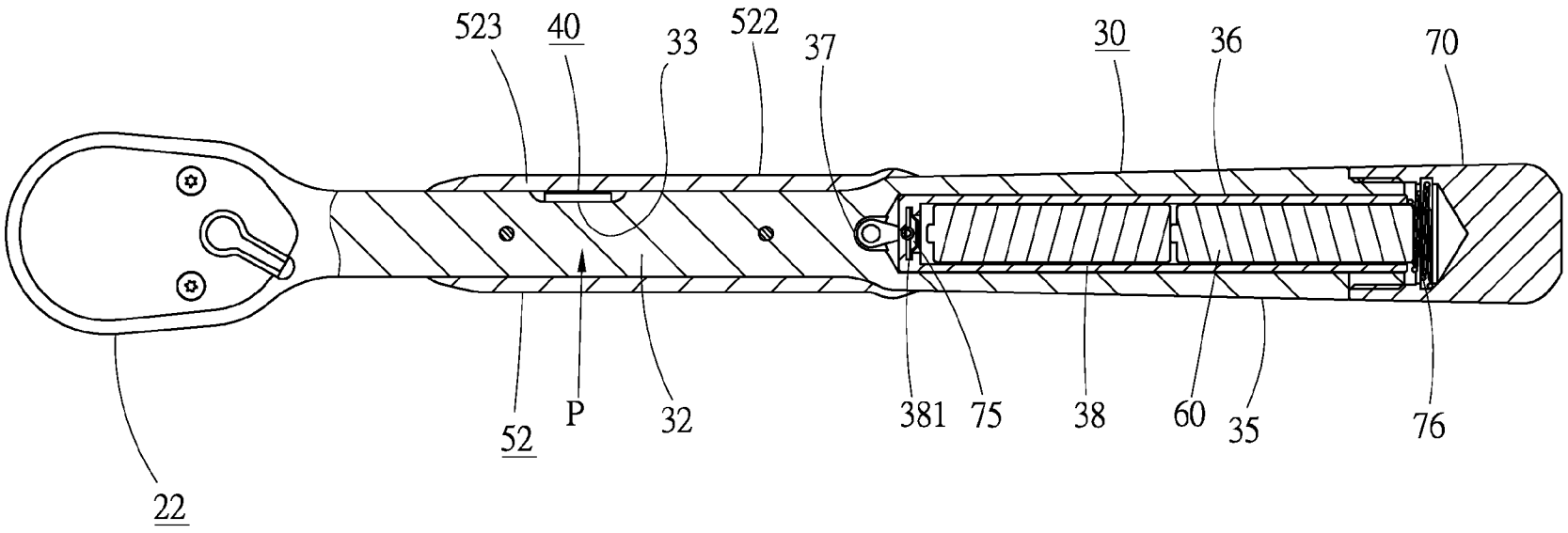
FIG. 4 is a sectional view taken along line 4-4 of FIG. 1.

Please now refer to FIGS. 2 to 4. The shank body 30 has a front shank section 32 and a handle section 35 positioned behind the front shank section 32. The front shank section 32 is a solid structure, whereby the wrench main body 20 has sufficient strength to bear the action force in use. At least one recess 33 is formed on the wall face of one side of the front shank section 32. A top face of the front shank section 32 is inward depressed to form an elongated platform 34. The platform 34 is lower than a top edge of the front shank section. A lower end of the platform 34 is positioned at a junction between the front shank section 32 and the handle section 35. The recess 33 is formed in a position within the range of the platform 34. The handle section 35 has an outer diameter larger than an outer diameter of the front shank section 32. A rear end of the handle section 35 is inward recessed to form a cavity 36. An inner end of the cavity 36 is positioned at the junction between the front shank section and the handle section. In use of the wrench, the action force applied to the wrench mainly acts on the front shank section 32. Therefore, the hollow design of the handle section 35 will not affect the structural strength of the wrench. A through hole 37 is formed at the rear end of the platform 34 in communication with the inner end of the cavity 36. A plastic-made insulation sleeve 38 is mounted in the cavity 36.

The torque sensor 40 is disposed in the recess 33 of the shank body 30. In practice, each of the wall faces of two sides of the front shank section 32 can be formed with a recess, whereby two torque sensors can be respectively disposed in the recesses.

The electronic operation/control device 50 is mounted on the shank body 30 of the wrench main body 20 as an operation interface and display interface of the wrench 10. To speak more specifically, the operation/control device 50 is mounted on the platform 34 of the front shank section 32. The operation/control device 50 has a housing 52, a circuit board 54, several pushbuttons 56 and at least one electronic display screen 58 disposed on the housing 52. The circuit board 54 is inbuilt with a microprocessor and several circuit units for executing the respective functions of the wrench, for example, torque detection circuit, power circuit, input/output circuit, display circuit, etc. The sensor 40, the pushbuttons 56 and the display screen 58 are all electrically connected to the circuit board 54. The housing 52 of the electronic operation/control device 50 is mounted on the platform 34 of the front shank section 32 by means of several securing members such as screws 59, whereby the operation/control device 50 is fixed on the shank body. The operation/control device 50 is disposed on the platform 34 of the shank body 30 so that the volume of the operation/control device 50 that outward protrudes from the shank body 30 is minified.

Figure 5:
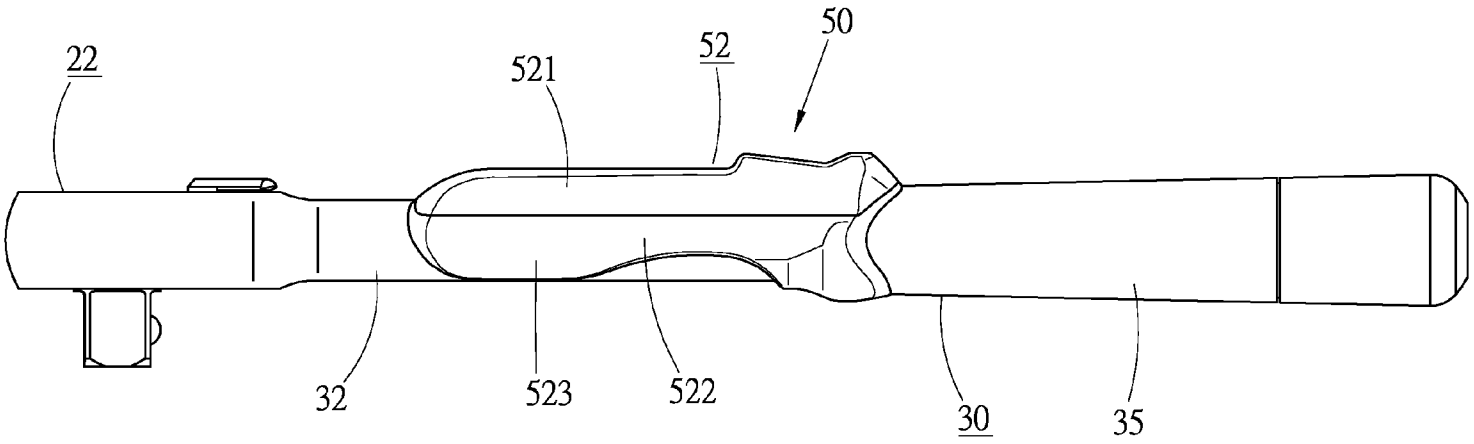
FIG. 5 is a side view of the preferred embodiment of the present invention.
Figure 6:
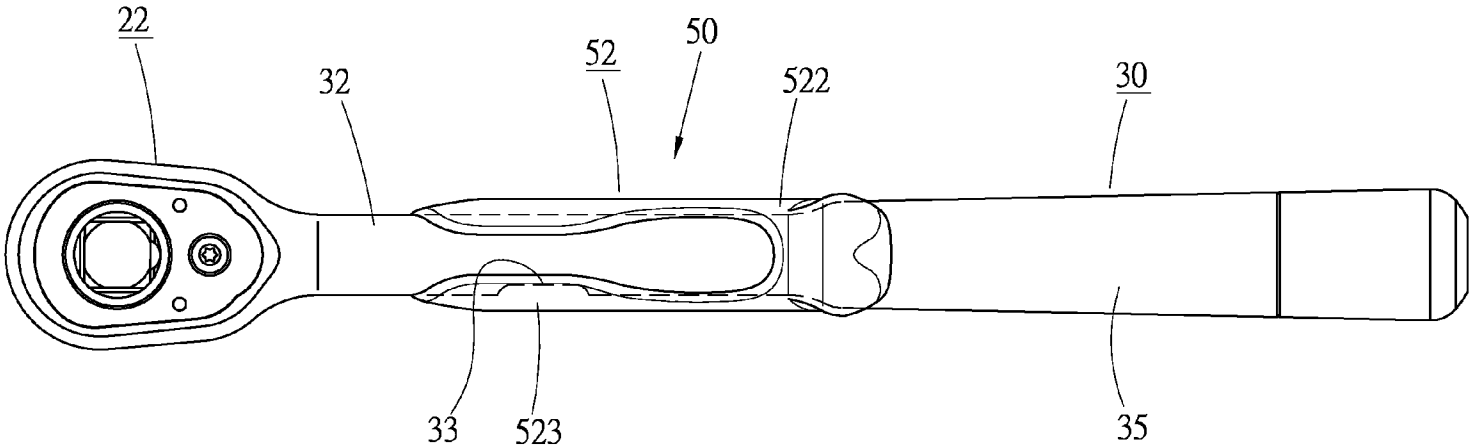
FIG. 6 is a bottom view of the preferred embodiment of the present invention.

Please further refer to FIGS. 5 and 6. In this embodiment, the housing 52 is composed of an upper casing 521 and a lower casing 522 assembled with each other. The upper casing 521 is made of inflexible material such as plastic material. The electronic components including the circuit board 54, the pushbuttons 56 and the electronic display screen 58 are mounted on the upper casing 521. The upper casing 521 is seated on the platform 34. The lower casing 522 is made of flexible material such as rubber. The lower casing 522 has two sidewalls 523. The lower casing 522 encloses the circumference of the front shank section 32. One of the side walls 523 blocks the recess 33 of the front shank section 32 to prevent water from splashing onto the sensor 40. The lower casing 522 is made of flexible material so that the shank body can be sealedly enclosed in the lower casing 522.

A tail cap 70 is detachably assembled with the rear end of the shank body 30 (by means of such as screwing or other equivalent measure) so as to close the cavity 36.

A first conductive member 75 is assembled in a notch 381 of an inner end of the insulation sleeve 38 and disposed in the inner end of the cavity 36. A second conductive member 76 is disposed in the tail cap 70.

In this embodiment, two cells 60 are placed into the insulation sleeve 38 of the cavity 36 of the shank body 30 into contact with the first and second conductive members 75, 76 as power source of the wrench 10. The through hole 37 serves as a passage for electrical conduction between the electronic operation/control device 50 and the cells 60. For example, a wire (not shown) can be conducted through the through hole 37 to connect the circuit board 54 of the operation/control device 50 and the conductive member 75, whereby the power of the cells can be supplied to the operation/control device 50. Alternatively, referring to FIGS. 2 and 3, in this embodiment, the first conductive member 75 has a conductive plate section 751 and a lug section 752. The lug section 752 is fixed on a bottom wall of the through hole 37 by a small screw 753. The conductive plate section 751 extends through the through hole 37 to the platform 34 to electrically connect with the circuit board 54. This can also achieve the power transmission effect. The pushbuttons 56 are power pushbutton and function pushbutton of the operation/control device 50 for powering on/off the wrench and executing the use functions of the wrench, for example, but not limited, numeral input, selection, setting, saving, etc. The function pushbutton is also used to switch the display screen between different use interfaces including displayed torque and set torque.

In use, the head section 22 of the wrench 10 is fitted onto a threaded member to wrench the same. The sensor 40 will detect the flexion extent of the shank body 30 to display the torque value on the display screen 58 for a user to know the magnitude of the application force of the wrench.

The present invention is advantageous over the conventional wrench in that the front shank section 32 of the wrench of the present invention is formed with the recessed platform 34 for assembling the electronic operation/control device 50 thereon. In this case, the volume of the operation/control device 50 is partially positioned in the platform 34 and only the rest of the volume outward protrudes from the shank body. Accordingly, the outward protruding volume of the operation/control device is reduced so that the total volume of the wrench is minified. The miniaturization of the volume of the wrench can reduce the limitation of use of the wrench, whereby the wrench can be conveniently used in a narrow space.

The cells are mounted in the shank body 30, not in the electronic operation/control device 50 so that the volume of the electronic operation/control device 50 is further minified.

The front shank section 32 of the shank body 30 is a solid structure. This not only makes the wrench have sufficient strength, but also reduces the outer diameter of the front shank section. Accordingly, the volume of the electronic operation/control device is further miniaturized.

Besides, the outer diameter of the shank body is two-dimensionally reduced in the detection position of the torque sensor 40, which is indicated by symbol P of FIGS. 3 and 4. That is, the platform 34 leads to height reduction of the shank body and the recess 33 leads to width reduction of the shank body. Accordingly, the flexion of the shank body in the detection position P is more apparent and the flexion extent will become larger. In this case, the sensor 40 will become more sensitive to provide better flexion detection effect and more precise torque value.

The above embodiments are only used to illustrate the present invention, not intended to limit the scope thereof. Many modifications of the above embodiments can be made without departing from the spirit of the present invention.

What is claimed is:

1. An electronic torque wrench comprising:

a wrench main body including a head section and a shank body connected with the head section, a drive assembly being disposed in the head section, the shank body having a front shank section and a handle section positioned behind the front shank section, at least one recess being formed on a wall face of at least one side of the front shank section, a top face of the front shank section being inward depressed to form an elongated platform, the platform being lower than a top edge of the front shank section, the recess being formed in a position within the range of the platform, a rear end of the handle section being inward recessed to form a cavity, a through hole being formed on the shank body in communication with the platform and the cavity;

at least one torque sensor disposed in the recess of the shank body;

an electronic operation/control device having a housing and several electronic components mounted on the housing, the electronic operation/control device being disposed on the platform of the shank body;

a tail cap detachably mounted at a rear end of the shank body;

a first conductive member and a second conductive member, the first conductive member being disposed in an inner end of the cavity, the second conductive member being disposed in the tail cap; and at least one cell placed in the cavity of the shank body in contact with the first and second conductive members, the electronic operation/control device being electrically connected to the cell through the through hole.

2. The electronic torque wrench as claimed in claim 1, wherein the front shank section is solid and has an outer diameter smaller than an outer diameter of the handle section.

3. The electronic torque wrench as claimed in claim 2, wherein a wire is conducted through the through hole to electrically connect the first conductive member with the electronic operation/control device.

4. The electronic torque wrench as claimed in claim 2, wherein the first conductive member has a conductive plate section extending through the through hole to electrically connect with the electronic operation/control device.

5. The electronic torque wrench as claimed in claim 2, wherein the housing of the electronic operation/control device is composed of an upper casing and a lower casing assembled with each other, the upper casing being seated on the platform, the electronic components of the electronic operation/control device being arranged on the upper casing, the lower casing enclosing a circumference of the front shank section to block the recess.

6. The electronic torque wrench as claimed in claim 5, wherein the upper casing is made of inflexible material, while the lower casing is made of flexible material.

7. The electronic torque wrench as claimed in claim 1, wherein a rear end of the platform is positioned at a junction between the front shank section and the handle section.

8. The electronic torque wrench as claimed in claim 7, wherein the through hole is formed at the rear end of the platform in communication with an inner end of the cavity.

9. The electronic torque wrench as claimed in claim 8, wherein a wire is conducted through the through hole to electrically connect the first conductive member with the electronic operation/control device.

10. The electronic torque wrench as claimed in claim 8, wherein the first conductive member has a conductive plate section extending through the through hole to electrically connect with the electronic operation/control device.

11. The electronic torque wrench as claimed in claim 8, wherein the housing of the electronic operation/control device is composed of an upper casing and a lower casing assembled with each other, the upper casing being seated on the platform, the electronic components of the electronic operation/control device being arranged on the upper casing, the lower casing enclosing a circumference of the front shank section to block the recess.

12. The electronic torque wrench as claimed in claim 11, wherein the upper casing is made of inflexible material, while the lower casing is made of flexible material.

13. The electronic torque wrench as claimed in claim 7, wherein a wire is conducted through the through hole to electrically connect the first conductive member with the electronic operation/control device.

14. The electronic torque wrench as claimed in claim 7, wherein the first conductive member has a conductive plate section extending through the through hole to electrically connect with the electronic operation/control device.

15. The electronic torque wrench as claimed in claim 1, wherein a wire is conducted through the through hole to electrically connect the first conductive member with the electronic operation/control device.

16. The electronic torque wrench as claimed in claim 1, wherein the first conductive member has a conductive plate section extending through the through hole to electrically connect with the electronic operation/control device.

17. The electronic torque wrench as claimed in claim 1, wherein the housing of the electronic operation/control device is composed of an upper casing and a lower casing assembled with each other, the upper casing being seated on the platform, the electronic components of the electronic operation/control device being arranged on the upper casing, the lower casing enclosing a circumference of the front shank section to block the recess.

18. The electronic torque wrench as claimed in claim 17, wherein the upper casing is made of inflexible material, while the lower casing is made of flexible material.

19. The electronic torque wrench as claimed in claim 1, wherein the electronic components of the electronic operation/control device include a circuit board, at least two push-buttons and an electronic display screen.

20. The electronic torque wrench as claimed in claim 1, further comprising an insulation sleeve mounted in the cavity, the cell being placed in the insulation sleeve, the first conductive member being mounted in an inner end of the insulation sleeve.

* * * * *